US005088222A

United States Patent [19]

Larson

[11] Patent Number: 5,088,222

[45] Date of Patent: Feb. 18, 1992

[54] FIREARM SAFETY

[75] Inventor: Mark A. Larson, Colona, Ill.

[73] Assignee: Springfield Armory, Inc., Geneseo, Ill.

[21] Appl. No.: 650,050

[22] Filed: Feb. 4, 1991

[51] Int. Cl.[5] ..... F41A 17/56

[52] U.S. Cl. ..... 42/70.04; 42/70.05; 89/148

[58] Field of Search ..... 42/70.04, 70.05, 69.03, 42/70.01, 70.08; 89/148

[56] References Cited

U.S. PATENT DOCUMENTS

| | | | |
|---|---|---|---|
| 1,896,820 | 2/1933 | Jolidon | 89/148 |
| 2,846,925 | 8/1958 | Norman | 89/148 |
| 3,757,634 | 9/1973 | Uria et al. | 89/148 |
| 4,306,487 | 12/1981 | Beretta | 89/148 |
| 4,589,327 | 5/1986 | Smith | 89/148 |

OTHER PUBLICATIONS

Shooting Times, "Is Your Safety Really Safe?", Apr. 1973, pp. 40–43 and 78.

*Primary Examiner*—Michael J. Carone

*Attorney, Agent, or Firm*—Woodard, Emhardt, Naughton, Moriarty & McNett

[57] ABSTRACT

A semi-automatic pisor of living a slide mounted to a frame is disclosed. The pistol has a hammer assembly and a trigger bar assembly. A trigger bar moves the sear during firing, causing the sear to disengage the hammer. A safety is provided having a cam projection which, upon movement of the safety, provides a caming action to urge the trigger bar downwardly, out of engagement with the sear. A second projection moves to obstruct movement of the sear to prevent firing. Disengagement of the trigger bar from the sear in the safe position eliminates mechanical stress on a forward projecting arm of the sear.

19 Claims, 5 Drawing Sheets

FIREARM SAFETY

BACKGROUND OF THE INVENTION

This invention relates generally to firearm safeties, and more specifically to a safety to disengage the sear.

The assignee of the present invention, Springfield Armory, Inc., sells a model P-9 double action pistol. This pistol is a semi-automatic, having a thumb safety which moves between a fire and a safe position. Such safety not only locks the slide against rearward movement, but also provides a projection which, when in the safe position, obstructs movement of the sear to prevent the hammer catch of the sear from disengaging the hammer, thus preventing firing. Although the P-9 pistol has been safe and reliable, it is always desirable to further improve safety.

In the P-9 type pistol, the sear has a forwardly projecting arm. It is this forwardly projecting arm which is obstructed by the projection on the safety as set forth above. However, it was realized that with this configuration, when the pistol was in a "safe" mode and force was exerted on the trigger, force was transmitted through the trigger to the trigger bar, from the trigger bar to the sear, and from the sear into the forwardly projecting arm of the sear. Such force exerted mechanical stress on the forwardly projecting arm, thereby creating a slight risk that the arm could break off under stress, creating the possibility that the weapon could accidentally discharge.

The present invention alleviates this problem while maintaining all of the pre-existing safety benefits of the older model design. In particular, when the safety is engaged, it not only obstructs movement of the sear, as described above, but it also uses a caming action to urge the trigger bar downwardly. By so doing, the trigger bar's path of movement when the trigger is pulled is relocated beneath and out of engagement with the sear. Accordingly, no matter how much force is exerted on the trigger, none of this force is transmitted into the sear (and, accordingly the forward projecting arm of the sear). Thus, the present invention provides a safer firearm without significant additional manufacturing costs.

SUMMARY OF THE INVENTION

According to one embodiment, the present invention provides a firearm having a safety comprising a frame supporting a barrel and a trigger assembly. A trigger bar is reciprocally moveable in response to movement of the trigger. A sear is mounted in the frame and has a catch which engages the hammer in a cocked position. During firing, the trigger bar engages and moves the sear to cause the catch to disengage the hammer assembly. A safety is moveable between a safe position and a fire position and comprises a pivot shaft mounted transversely in the frame. The safety has a manually actuated lever arm for pivoting the pivot shaft. A cam projection is connected to and projects radially outward from the pivot shaft a radial cam distance, wherein the trigger bar passes beneath the pivot shaft at a distance which is less than the radial cam distance. The cam projection pivots downwardly in response to pivoting of the shaft so that the cam projection engages the trigger bar in a caming action to urge the trigger bar downwardly out of engagement with the sear with the safety in the safe position.

One object of the present invention is to provide an improved firearm safety.

Another object is to reduce mechanical stress in the sear of a firearm to reduce the chance of accidental discharge.

Another object is to improve firearm safety with a relatively low cost modification to a firearm.

These and other objects are apparent from the following description and drawings.

DESCRIPTION OF THE PREFERRED EMBODIMENT

Figure 1:
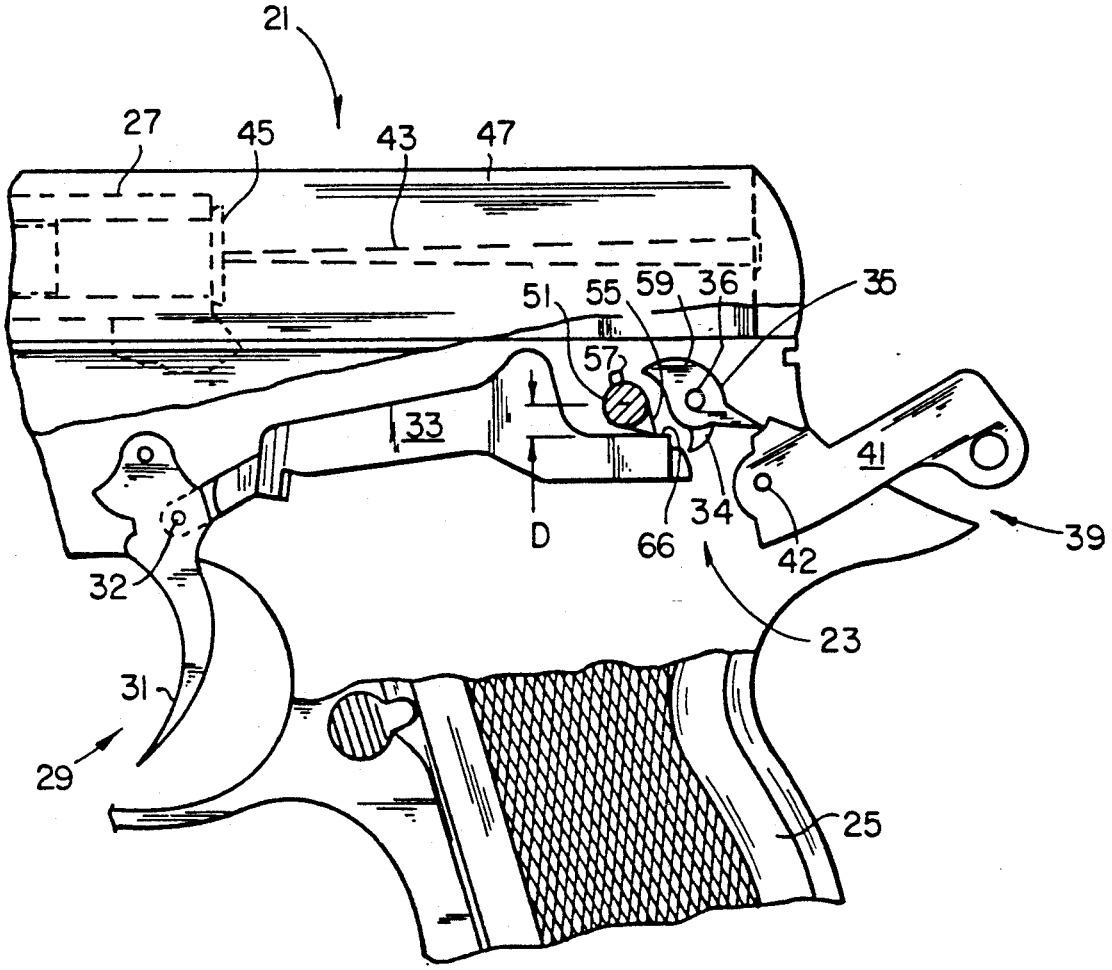
FIG. 1 is a partial side cut-away view showing the preferred embodiment of the present invention in a "fire" position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawing figures, firearm 21 is illustrated. As set forth, preferably firearm 21 is a semi-automatic pistol, such as Springfield Armory, Inc.'s model P-9 nine millimeter caliber double action pistol. The present invention may be utilized in a variety of other firearms and pistols. However, for purposes of illustration the present invention is described in a P-9 pistol, and, the Springfield Armory P-9 Pistol's Owner's Manual, available from Springfield Armory, Inc., 420 West Main Street, Geneseo, Ill. 61254, U.S.A., is hereby incorporated herein by reference.

Firearm 21 includes safety 23 mounted in frame 25. Firearm 21 further includes barrel 27, trigger assembly 29, including trigger 31 pivotable about a pin, and a trigger bar 33. Trigger bar 33 is illustrated in isolation in FIGS. 6A–6D.

Figure 2:
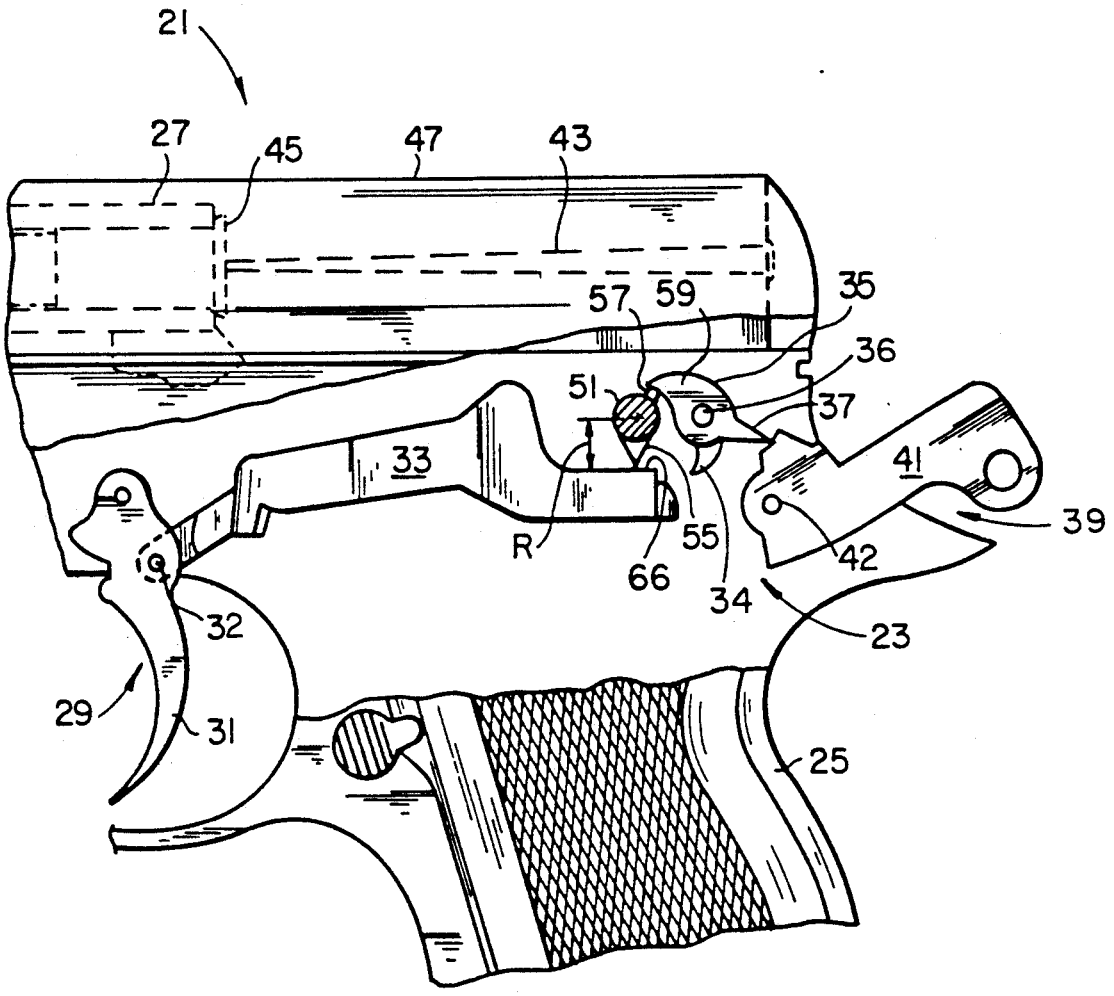
FIG. 2 is a partial side cut-away view of the embodiment of FIG. 1 in a "safe" position.

Sear 35 is pivotably moveable about pin 36 which is secured to frame 25. Pin 36 preferably is mounted in a separate housing (not shown) which in turn is secured to frame 25, with such housing not illustrated for drawing clarity of the other parts. Sear 35 includes a hammer catch 37, which as illustrated is a sharp, wedge-shaped projection pointed rearwardly. Hammer catch 37 engages hammer 41 of hammer assembly 39 at the notchs in hammer 41 illustrated in FIGS. 1 and 2. Hammer 41 pivots about pin 42 to a cocked position, as illustrated in FIGS. 1 and 2. Hammer 41 is spring biased forwardly so that upon movement of sear 35, the hammer catch disengages the hammer, causing the hammer to move forward, striking firing pin 43 and causing round of ammunition 45 to discharge. Firing pin 43 is mounted in the receiver or slide 47 which is slidably mounted on frame 25 as is conventionally known.

Movement of sear 35 is caused by sear catch 34 being contacted and pushed rearwardly by trigger bar 33. Trigger bar 33 is connected to trigger 31 of trigger assembly 29 at pin 32. Thus, in the fire position (FIG. 1) rearward movement of trigger 31 causes rearward movement of trigger bar 33. Trigger bar 33 pushes sear catch 34 rearwardly, thus causing sear 35 to pivot about pin 36 counterclockwise, as illustrated in FIG. 1. Note that trigger bar 33 contacts sear catch 34 along contact edge 69 of trigger bar 33 illustrated in FIGS. 6A, 6B and 6D. Counterclockwise movement of sear 35 causes hammer catch 37 to move upwardly, out of engagement with the notch of hammer 41, causing the weapon to fire as previously described.

When safety 23 of firearm 21 is moved to a "safe" position (FIG. 2), projection 57 obstructs downward movement of forwardly projecting sear arm 59. Such obstruction prevents the rotation of sear 35 as previously described, thereby preventing firing of the weapon.

Figure 4A:
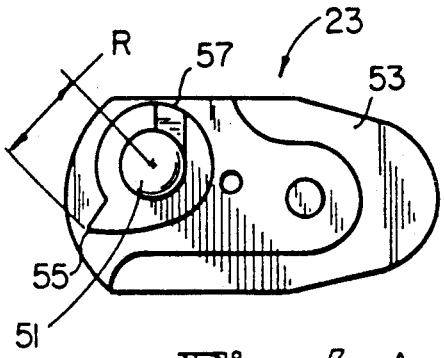
FIG. 4A is a side, interior view of the safety of the present invention, separate from the remainder of the firearm.
Figure 3:
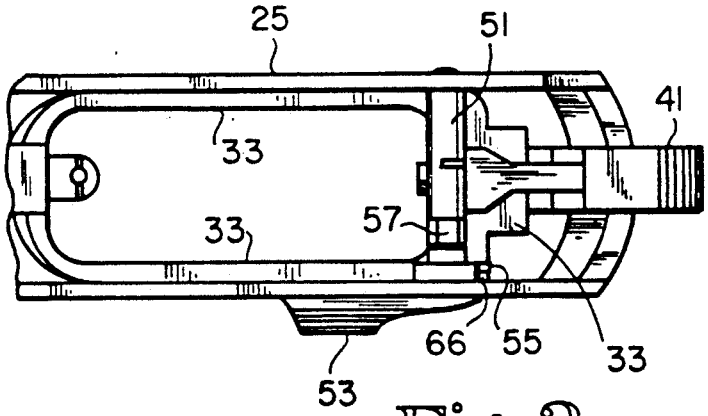
FIG. 3 is a partial top cut-away view showing a trigger bar, hammer, and safety mounted in a pistol frame according to the present invention.
Figure 4B:
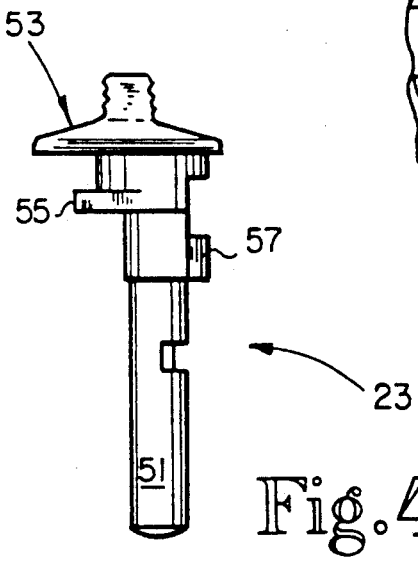
FIG. 4B is a rear elevation view of the safety of FIG. 4A.
Figure 6B:
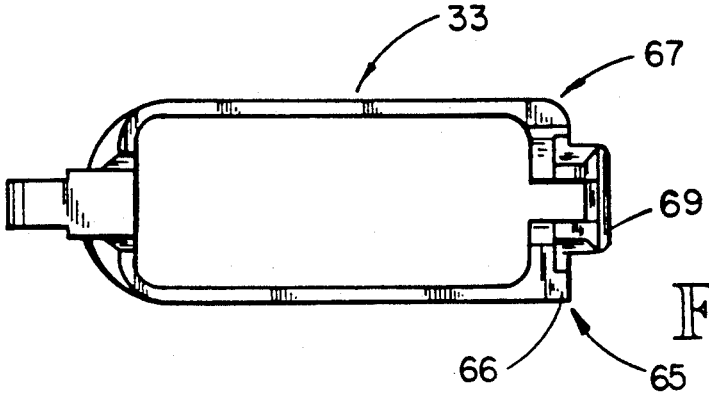
FIG. 6B is a top plan view of the trigger bar of FIG. 6A.
Figure 6A:
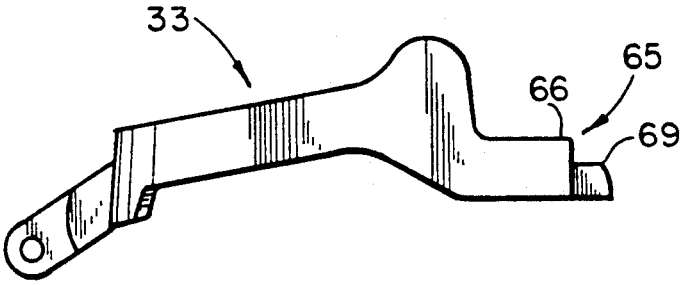
FIG. 6A is a side elevation view of a trigger bar according to the present invention, separate from the remainder of the firearm.
Figure 6D:
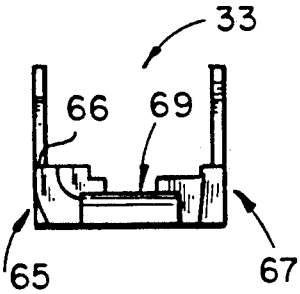
FIG. 6D is a rear elevation view of the trigger bar of FIG. 6A.
Figure 6C:
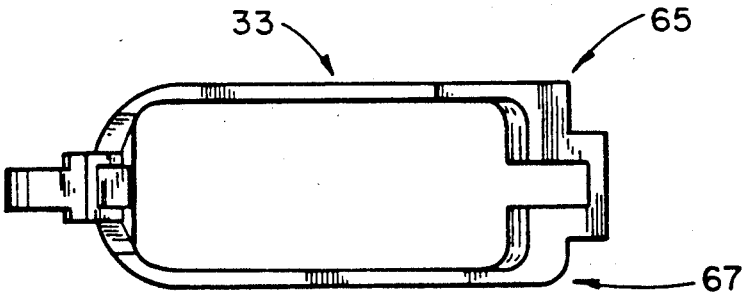
FIG. 6C is a bottom view of the trigger bar of FIG. 6A.

Safety 23 is shown in greater detail in FIGS. 3, 4A and 4B. Safety 23 includes a pivot shaft 51 mounted transversely in frame 25 and pivotable with respect thereto. Projection 57 is connected to and projects radially outward from pivot shaft 51. Lever arm 53 is secured to pivot shaft 51 for pivoting the shaft with respect to the frame, typically by movement of the operator's thumb on lever 53. These features of a pivot shaft, a projection, and a lever arm are shown in the prior art safety illustrated in FIG. 5 as safety 123 having pivot shaft 151, projection 157 and lever arm 153.

Figure 5:
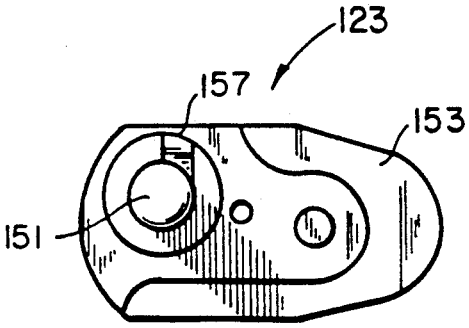
Fig. 5 PRIOR ART
FIG. 5 is a side, interior view of a prior art safety, separate from the remainder of a firearm.

By comparing FIG. 4A and FIG. 5, cam projection 55 (FIG. 4A) is shown, an additional feature not present in the prior art device of FIG. 5. Cam projection 55 projects a radial cam distance R from the axial center of pivot shaft 51. Cam 55 projects from an otherwise circular hub which nests into circular hole 61 (see FIG. 7), allowing pivotable movement of shaft 51. In the preferred embodiment, preferably radial cam distance R is greater than about 0.15 inches and typically ranges between 0.2 inches and 0.5 inches. In the preferred commercial mode, radial cam distance R is about 0.24 inches.

Referring to FIGS. 1 and 2, the engagement of radial cam projection 55 and top surface 66 of trigger bar 33 is illustrated. Upward movement of the safety lever arm causes shaft 51 to rotate clockwise, as illustrated in FIGS. 1 and 2, causing cam projection 55 to pivot downwardly in response to pivoting of pivot shaft 51. Cam projection 55 engages trigger bar 33 at top surface 66 in a caming action to urge trigger bar 33 downwardly out of engagement with sear 35 with safety 23 in the safe position as illustrated in FIG. 2. The portion of trigger bar 33 which ordinarily engages sear catch 34 to cause the weapon to fire is now urged downwardly so that the rearward path of travel of the trigger bar upon pulling of the trigger passes beneath sear 35 and sear catch 34. Thus, force is not transmitted from trigger bar 33 into sear 35. Accordingly, although projection 57 acts as a redundant safety, obstructing movement of sear arm 59, no force is imputed into sear arm 59 by pulling of the trigger, thus reducing the risk that arm 59 will break off under stress by some cause such as a metalurgical defect. Accordingly, a safer weapon is provided.

The caming action is provided by having radial cam distance R be greater than distance D illustrated in FIG. 1, with distance D being the distance which trigger bar 33 passes beneath the axial center of pivot shaft 51.

Figure 7:
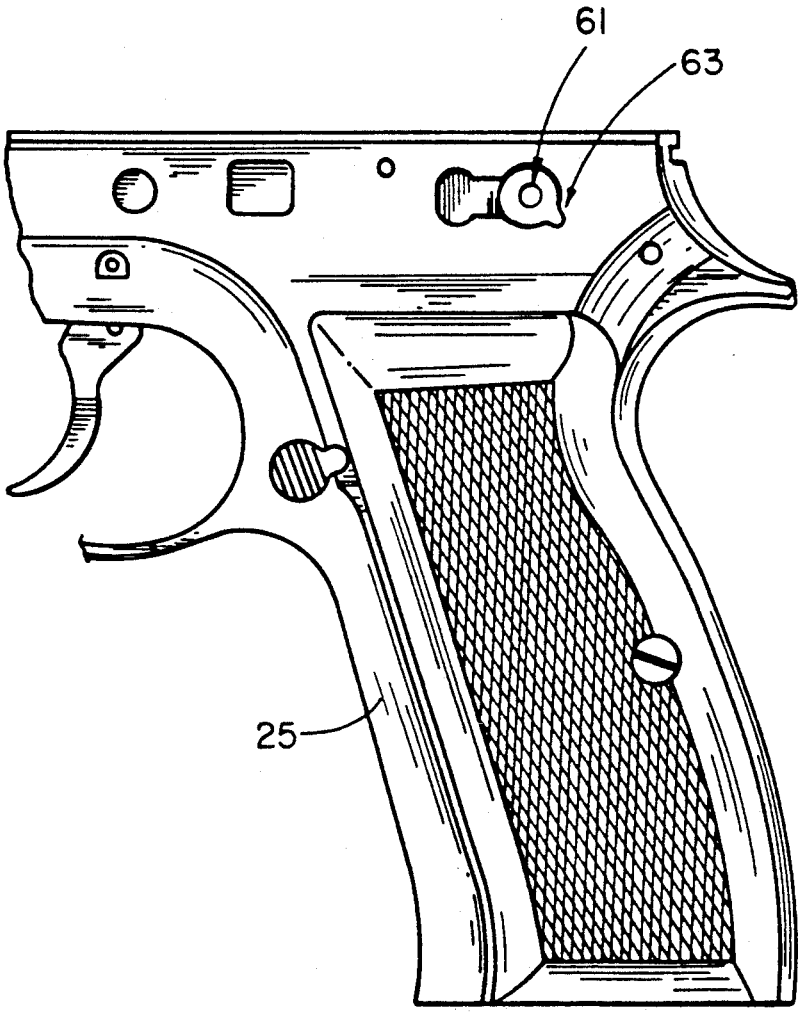
FIG. 7 is a partial side elevation view of a frame for a pistol of the present invention.

The foregoing advantages have been engineered and invented in the present invention to allow for relatively inexpensive manufacturing modifications. In particular, three modifications are utilized in the preferred embodiment. The first has been described above by comparing FIG. 5 with FIG. 4A, namely the addition of cam projection 55. The second is illustrated in FIGS. 6A–6D showing squared corner 65 and rounded corner 67. In prior conventional models, both corners were rounded. The present invention has been modified to provide squared corner 65 providing top surface 66 by the addition of material to trigger bar 33. Surface 66 provides a surface for cam projection 55 to engage to urge the trigger bar downwardly. It is to be understood that other configurations may be used to provide the caming action of the present invention, this configuration being especially well suited for the P-9 model pistol as the illustrated example. The third modification is illustrated in FIG. 7. FIG. 7 has round hole 61, a feature present in conventional prior devices. However, hole 61 has been modified to include radially enlarged portion 63 which is contiguous with hole 61 and is sized and shaped at least as large as cam projection 55 of safety 23 to allow cam projection 55 to pass through radially enlarged portion 63. This facilitates assembly, while being cosmetically covered in the final assembled form by lever arm 53. Note that in the fire position, cam projection 55 projects from pivot shaft 51 at an angle of about 45° below horizontal, with the horizontal being defined by the axial center of barrel 27. Correspondingly, it is preferred that radial projection 63 likewise be positioned approximately 45° below horizontal.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A firearm having a safety, comprising:

a frame supporting a barrel and a trigger assembly;

a trigger bar which is reciprocally movable in response to movement of said trigger assembly;

a sear mounted in said frame and having a hammer catch;

a hammer assembly mounted to said frame and biased forwardly to fire a round through said barrel, wherein said hammer assembly engages said hammer catch in a cocked position and disengages said catch during firing, and wherein said trigger bar engages and moves said sear during firing to cause said catch to disengage said hammer assembly; and, a safety movable between a safe position and a fire position to prevent firing of the firearm, wherein said safety comprises:

(a) a pivot shaft mounted transversely in said frame and pivotable with respect thereto;

(b) a manually actuated lever arm secured to said pivot shaft for pivoting said pivot shaft;

(c) a cam projection connected to and projecting radially outwardly from said pivot shaft a radial cam distance, wherein said trigger bar passes beneath said pivot shaft at a distance which is less than said radial cam distance, and wherein said cam projection pivots downwardly in response to pivoting of said pivot shaft so that said cam projection engages said trigger bar in a camming action to urge said trigger bar downwardly out of engagement with said sear with said safety in said safe position; and, (d) a second projection connected to and projecting radially outwardly from said pivot shaft, wherein said second projection swings, during movement of said safety from said fire position to said safe position, into an obstructing position to obstruct movement of said sear to prevent said hammer catch of said sear from disengaging said hammer assembly.

2. The firearm of claim 1 wherein said frame has a hole therein with said pivot shaft of said safety pivotably disposed in said hole, and wherein said hole includes a contiguous radially enlarged portion sized and shaped at least as large as said cam projection of said safety to allow said cam projection to pass through said radially enlarged portion of said hole.

3. The firearm of claim 2 wherein said firearm comprises a semi-automatic pistol having a slide mounted to said frame and around said barrel with said slide being slidable with respect to said frame.

4. The firearm of claim 3 wherein said sear includes a forwardly projecting sear arm which swings downwardly during movement of said sear during firing of the firearm, and wherein said second projection of said safety in said obstructing position obstructs downward movement of said sear arm to prevent firing.

5. The firearm of claim 4 wherein said radial cam distance is greater than about 0.15 inches.

6. The firearm of claim 5 wherein said radial cam distance is greater than about 0.2 inches and is less than about 0.5 inches.

7. The firearm of claim 6 wherein said radial cam distance is about 0.24 inches.

8. The firearm of claim 7 wherein said barrel defines horizontal and wherein said cam projection projects from said pivot shaft at an angle of about 45° below horizontal when said safety is in said fire position.

9. The firearm of claim 1 wherein said sear includes a forwardly projecting sear arm which swings downwardly during movement of said sear during firing of the firearm, and wherein said second projection of said safety in said obstructing position obstructs downward movement of said sear arm to prevent firing.

10. The firearm of claim 1 wherein said radial cam distance is greater than about 0.2 inches and is less than about 0.5 inches.

11. The firearm of claim 1 wherein said radial cam distance is about 0.24 inches.

12. The firearm of claim 1 wherein said barrel defines horizontal and wherein said cam projection projects from said pivot shaft at an angle of about 45° below horizontal when said safety is in said fire position.

13. The firearm of claim 2 wherein said radial cam distance is greater than about 0.2 inches and is less than about 0.5 inches.

14. A firearm having a safety, comprising:

a frame supporting a barrel and a trigger assembly;

a trigger bar which is reciprocally movable in response to movement of said trigger assembly;

a sear mounted in said frame and having a hammer catch;

a hammer assembly mounted to said frame and biased forwardly to fire a round through said barrel, wherein said hammer assembly engages said hammer catch in a cocked position and disengages said catch during firing, and wherein said trigger bar engages and moves said sear during firing to cause said catch to disengage said hammer assembly; and, a safety movable between a safe position and a fire position to prevent firing of the firearm, wherein said safety comprises:

(a) a pivot shaft mounted transversely in said frame and pivotable with respect thereto;

(b) a manually actuated lever arm secured to said pivot shaft for pivoting said pivot shaft;

(c) a cam projection connected to and projecting radially outwardly from said pivot shaft a radial cam distance, wherein said trigger bar passes beneath said pivot shaft at a distance which is less than said radial cam distance, and wherein said cam projection pivots downwardly in response to pivoting of said pivot shaft so that said cam projection engages said trigger bar in a camming action to urge said trigger bar downwardly out of engagement with said sear with said safety in said safe position; and, said frame has a hole therein with said pivot shaft of said safety pivotably disposed in said hole, and wherein said hole includes a contiguous radially enlarged portion sized and shaped at least as large as said cam projection of said safety to allow said cam projection to pass through said radially enlarged portion of said hole.

15. The firearm of claim 14 wherein said firearm comprises a semi-automatic pistol having a slide mounted to said frame and around said barrel with said slide being slidable with respect to said frame.

16. The firearm of claim 14 wherein said radial cam distance is greater than about 0.15 inches.

17. The firearm of claim 14 wherein said radial cam distance is greater than about 0.2 inches and is less than about 0.5 inches.

18. The firearm of claim 14 wherein said radial cam distance is about 0.24 inches.

19. The firearm of claim 14 wherein said barrel defines horizontal and wherein said cam projection projects from said pivot shaft at an angle of about 45° below horizontal when said safety is in said fire position.

* * * * *